US008607700B2

(12) United States Patent
Niswonger

(10) Patent No.: US 8,607,700 B2
(45) Date of Patent: Dec. 17, 2013

(54) ROLLER FRAME STRETCHER

(76) Inventor: John O. H. Niswonger, Calabasas, CA (US)

( * ) Notice: Subject to any disclaimer, the term of this patent is extended or adjusted under 35 U.S.C. 154(b) by 348 days.

(21) Appl. No.: 13/046,429

(22) Filed: Mar. 11, 2011

(65) Prior Publication Data

US 2011/0155003 A1 Jun. 30, 2011

Related U.S. Application Data

(63) Continuation-in-part of application No. 12/409,522, filed on Mar. 24, 2009, now Pat. No. 8,220,387, and a continuation-in-part of application No. 12/821,154, filed on Jun. 23, 2010, now Pat. No. 8,286,552, and a continuation-in-part of application No. 12/832,979, filed on Jul. 8, 2010, now abandoned, which is a continuation of application No. 11/827,729, filed on Jul. 13, 2007, now Pat. No. 7,752,963, application No. 13/046,429, which is a continuation-in-part of application No. 12/849,805, filed on Aug. 3, 2010, now Pat. No. 8,453,566.

(60) Provisional application No. 61/312,671, filed on Mar. 11, 2010, provisional application No. 61/070,702, filed on Mar. 24, 2008, provisional application No. 61/130,362, filed on May 31, 2008, provisional application No. 61/219,408, filed on Jun. 23, 2009, provisional application No. 60/830,712, filed on Jul. 13, 2006, provisional application No. 61/231,012, filed on Aug. 3, 2009, provisional application No. 61/370,430, filed on Aug. 3, 2010.

(51) Int. Cl.
*B05C 17/06* (2006.01)
*D06C 3/08* (2006.01)

(52) U.S. Cl.
USPC ..... 101/127.1; 38/102.1; 38/102.21

(58) Field of Classification Search
USPC ..... 101/114, 127.1, 129; 38/102, 102.1, 38/102.21, 102.4, 102.91
See application file for complete search history.

(56) References Cited

U.S. PATENT DOCUMENTS

| | | | |
|---|---|---|---|
| 221,845 | A | 10/1940 | Heyne |
| 360,191 | A | 8/1971 | Dubbs |
| 3,805,873 | A | 4/1974 | Bloomfield |
| 3,962,805 | A | 6/1976 | Hamu |
| 3,982,306 | A | 9/1976 | Curry |
| 4,134,340 | A | 1/1979 | Larson |
| 4,186,660 | A | 2/1980 | Key |
| 4,249,589 | A | 2/1981 | Loeb |
| 4,338,860 | A | 7/1982 | Hamu |
| 4,345,390 | A | 8/1982 | Newman |
| 4,409,749 | A | 10/1983 | Hamu |
| 4,462,174 | A | 7/1984 | Messerschmitt |
| 4,525,909 | A | 7/1985 | Newman |
| 4,539,734 | A | 9/1985 | Messerschmitt |

(Continued)

*Primary Examiner* — Ren Yan
(74) *Attorney, Agent, or Firm* — Ronald L Rohde

(57) ABSTRACT

Mesh may be stretched between rollers of a roller frame using a tool to grip a locking strip slot in the roller at about the middle of the roller and turning the roller using the tool. A rectangular frame may support the roller frame in a planer configuration during stretching. A jack coupled to the rectangular frame may be used to apply rotational force to the tool for rotating the roller. A triangular locking strip may be stitched to the mesh for insertion into the locking strip slot from the top instead of the end of the slot.

13 Claims, 15 Drawing Sheets

(56) References Cited

U.S. PATENT DOCUMENTS

| | | | | |
|---|---|---|---|---|
| 4,694,746 | A | | 9/1987 | Hamu |
| 4,702,783 | A | | 10/1987 | Mason, III |
| 4,799,299 | A | | 1/1989 | Campbell |
| 4,860,467 | A | | 8/1989 | Larson |
| 4,893,406 | A | | 1/1990 | Larson |
| 5,018,442 | A | | 5/1991 | Hamu |
| 5,096,524 | A | | 3/1992 | Ohtani et al. |
| 5,097,761 | A | | 3/1992 | Hamu |
| 5,113,611 | A | | 5/1992 | Rosson |
| 5,127,176 | A | | 7/1992 | Newman |
| 5,148,745 | A | | 9/1992 | Hamu |
| 5,163,367 | A | | 11/1992 | Newman |
| 5,265,534 | A | | 11/1993 | Hamu |
| 5,271,171 | A | | 12/1993 | Smith |
| 5,274,934 | A | | 1/1994 | Newman, Jr. |
| 5,275,098 | A | | 1/1994 | Larson |
| 5,301,737 | A | | 4/1994 | Martin |
| 5,379,691 | A | | 1/1995 | Hamu et al. |
| 5,443,003 | A | | 8/1995 | Larson |
| 5,503,068 | A | | 4/1996 | Newman |
| 5,648,189 | A | | 7/1997 | Newman |
| 5,676,052 | A | | 10/1997 | Wegrzyn et al. |
| 5,771,801 | A | | 6/1998 | Newman et al. |
| 5,802,971 | A | | 9/1998 | Hamu et al. |
| 5,806,422 | A | | 9/1998 | Hamu |
| 5,806,425 | A | | 9/1998 | Newman et al. |
| 5,813,328 | A | | 9/1998 | Hamu |
| 5,832,822 | A | | 11/1998 | Hamu |
| 5,893,227 | A | | 4/1999 | Johansson et al. |
| 5,911,266 | A | | 6/1999 | Jacobs |
| 5,913,263 | A | * | 6/1999 | Hruska ..... 101/114 |
| 5,937,753 | A | * | 8/1999 | McKeever ..... 101/127.1 |
| 5,974,962 | A | | 11/1999 | Hamu et al. |
| 5,988,059 | A | | 11/1999 | Hamu |
| 6,070,526 | A | | 6/2000 | Larson |
| 6,098,538 | A | | 8/2000 | Hamu |
| 6,318,255 | B1 | | 11/2001 | Larson |
| 6,505,552 | B1 | | 1/2003 | Larson |
| 6,564,488 | B2 | | 5/2003 | Wittenberg |
| 6,698,123 | B2 | | 3/2004 | Smith |
| 6,736,057 | B1 | | 5/2004 | Larson |
| D524,365 | S | | 7/2006 | Hamu |
| D549,567 | S | | 8/2007 | Hamu |
| 7,497,159 | B2 | | 3/2009 | Kasuya |
| 7,797,864 | B2 | | 9/2010 | Larson |
| 2002/0139258 | A1 | | 10/2002 | Hamu |
| 2003/0075258 | A1 | | 4/2003 | Zhang et al. |
| 2004/0025383 | A1 | * | 2/2004 | Milton ..... 38/102.91 |
| 2004/0079245 | A1 | | 4/2004 | Larson |
| 2005/0196585 | A1 | | 9/2005 | Yu |
| 2005/0268800 | A1 | | 12/2005 | Hamu |
| 2006/0010728 | A1 | | 1/2006 | Larson |
| 2006/0010730 | A1 | | 1/2006 | Larson |
| 2007/0000160 | A1 | | 1/2007 | Larson |
| 2008/0235999 | A1 | | 10/2008 | Larson |
| 2008/0236418 | A1 | | 10/2008 | Larson |
| 2009/0145559 | A1 | | 6/2009 | Glasl et al. |

* cited by examiner

ROLLER FRAME STRETCHER

CROSS-REFERENCE TO RELATED APPLICATIONS

This application claims priority and benefit of U.S. provisional patent application No. 61/312,671 titled "Roller Frame Stretcher," filed on Mar. 11, 2010.

This application is a continuation in part of and claims priority and benefit of U.S. patent application Ser. No. 12/409,522, titled "PIVOTING LOCKING STRIP SYSTEM AND APPARATUS FOR SILKSCREEN FRAME," filed on Mar. 24, 2009, now U.S. Pat. No. 8,220,387 which in turn claims priority and benefit of U.S. provisional patent application No. 61/070,702 titled "Pivoting locking strip system and apparatus for silkscreen frame," filed on Mar. 24, 2008, and U.S. provisional patent application No. 61/130,362 titled "Panel and mesh for pivoting locking strip and silkscreen system," filed on May 31, 2008.

This application is a continuation in part of and claims priority and benefit of U.S. patent application Ser. No. 12/821,154, titled "SCREEN-PRINTING PANEL," filed on Jun. 23, 2010, now U.S. Pat. No. 8,286,552 which in turn claims priority and benefit of U.S. provisional patent application No. 61/219,408 titled "SILKSCREEN PANEL," filed on Jun. 23, 2009 and U.S. provisional patent application No. 61/370,430 titled "SCREEN-PRINTING FRAME AND TOOL AND SCOOP COATER," filed on Aug. 3, 2010.

This application is a continuation in part of and claims priority and benefit of U.S. patent application Ser. No. 12/832,979, titled "APPARATUS AND METHOD FOR SCREEN TENSIONING," filed Jul. 8, 2010, now abandoned which is a continuation of U.S. patent application Ser. No. 11/827,729, filed on Jul. 13, 2007, now U.S. Pat. No. 7,752,963, which in turn claims priority and benefit of U.S. provisional patent application No. 60/830,712 titled "Improved Apparatus and Method for Screen Tensioning," filed on Jul. 13, 2006.

This application is a continuation in part of and claims priority and benefit of U.S. patent application Ser. No. 12/849,805, titled "SCREEN-PRINTING FRAME," filed on Aug. 3, 2010, now U.S. Pat. No. 8,453,566 which in turn claims priority and benefit of U.S. provisional patent application No. 61/231,012 titled "Silkscreen Frame," filed on Aug. 3, 2009, U.S. provisional patent application No. 61/312,671 titled "Roller Frame Stretcher," filed on Mar. 11, 2010, and U.S. provisional patent application No. 61/370,430 titled "SCREEN-PRINTING FRAME AND TOOL AND SCOOP COATER," filed on Aug. 3, 2010. All of the above applications are incorporated herein by reference in their entirety.

FIELD OF THE APPLICATION

The present application relates generally to silkscreen stretching apparatus, and more particularly to roller frame stretching apparatus.

DESCRIPTION OF RELATED ART

Roller frames are popular for stretching screen printing mesh or fabric. Roller frames provide for adjusting mesh tension, applying extremely high tension to mesh, and re-tensioning mesh after the tension has relaxed. A roller frame typically includes a roller that has longitudinal groove to hold the mesh. The groove, or locking strip slot, is in the shape of an inverted "T" and generally extends the length of the roller. A locking strip is used to secure the mesh or fabric within the groove. The mesh is pushed into the groove from the top. The locking strip is inserted into the groove from an end of the groove and pushed or pulled to slide it lengthwise through the groove to secure the fabric. Unfortunately, it is difficult to work the locking strip along the length of the groove. It is also difficult to handle loose mesh. Complex accessories and devices are often used for holding mesh in place within the groove while sliding the locking strip in. The locking strip catches on the fabric and the loose mesh is stiff and tends work out of the groove.

Extreme forces are often exerted on the mesh at the corners of the roller frame during tensioning. The extreme forces result from tension applied at right angles near the corners. These forces result in tearing the mesh. Complex "corner softening" procedures and costly accessories are used with minimal success to adjust the position of the mesh within the locking strip groove for reducing the forces and resultant tearing at the corners. Generally, corner softening is more of an art than a science and requires experience, patience, and skill to perform properly.

Generally tension is applied to rollers using a special wrench to apply torque to a hexagonal plug at each end of the roller. Upon reaching a desired torque, a bolt secures the end of the plug. The process is repeated on the other end and then the torque is released. Unfortunately, the special wrenches are expensive because they are oversized open-end hex wrenches that are machined.

If the same torque is not applied to each end plug on both ends of the roller, the roller can twist after the bolt is tightened. A twisted roller results in a frame that is not flat or planar and not usable. In an attempt to apply equal torque to both ends of the roller, two wrenches are often used simultaneously and then the bolt at each end is tightened before releasing the torque. Unfortunately, it is difficult to apply the exactly the same force to both wrenches. Thus, a twisted roller still frequently results after stretching using two wrenches, resulting in a frame that is not flat and not usable. A complex flattening procedure must then be performed involving partially loosening the bolts, making adjustments, and then retightening the bolts. Flattening a twisted roller frame is more of an art than a science and requires experience, patience, and skill to perform properly. A complex apparatus that is carefully calibrated and adjusted can be used to reduce the torque difference between the two wrenches. Unfortunately, the apparatus is very expensive, difficult to maintain in calibration, and requires regular replacement of worn out parts that are also expensive.

SUMMARY

The above problem of applying equal torque at both ends of the roller may be solved by applying torque at the center of the roller, instead of at the ends. A torque tool that is configured to grip the locking strip slot at the center may be used to apply the torque to the roller at the center instead of the ends. Thus, the resulting torque at each end that is the same. Bolts at each end of the roller may secure the end plugs of the roller in position while they are both at the same torque. Then torque at the center of the roller may be released. The torque tool can be fabricated using an inexpensive aluminum extrusion for a lower cost than machining an oversized open-end hex wrench. Maintenance, calibration and adjustment of the wrench are not required.

The above problem of inserting a locking strip into the locking strip slot from the end of the slot may be solved by using a locking strip that is sewn to an edge of the mesh and that has an approximately triangular cross-section. The triangular cross-section permits insertion of the locking strip into the locking strip slot from the top instead of the end of the slot. Thus, there is no need to slide the locking strip in from the end of the slot. The stitching secures the locking strip to the mesh and makes it easier to handle during insertion. The stitching also holds the mesh within the slot more strongly for greater tension. Corner softening can be accomplished by adjusting the length of the stitching along the locking strip to leave a gap between the end of the stitching and the corner.

In some embodiments, a system for stretching a roller frame including a roller and a mesh panel includes a rectangular frame configured to support the roller frame and a torque tool configured to grip the roller at an intermediate position about halfway between opposite ends of the roller. The torque tool is further configured to rotate the roller for applying tension to the mesh panel. A jack is attached to the rectangular frame at an intermediate position about halfway between two corners and configured to rotate the torque tool. The torque tool includes a grip configured engage a locking strip disposed in the roller and to apply a tangential force to the roller. The torque tool further includes a bearing surface configured to apply a radial force to the roller.

In some embodiments, a method for stretching a mesh panel on a roller frame includes supporting corners of the roller frame, gripping a roller of the roller frame at an intermediate position between two corners, and rotating the roller to a tension position to stretch the mesh. The method further includes securing the roller against rotation at the tension position to maintain the mesh panel in a stretched state. The method may include folding the mesh around a locking strip stitched to an edge of the mesh panel and inserting the locking strip into a symmetric locking strip slot in the roller. The locking strip slot may be gripped at about the center of the roller using a tool and a torque may be applied to the roller using the tool to rotate the roller.

In some embodiments, the mesh panel includes a locking strip sewn to an edge for securing the mesh within a symmetric "T" locking strip slot of the roller. A cross section of the locking strip may describe a generally triangular shape having a first side and a second side forming a point having a radius and sized for insertion into a first side groove of the locking strip slot. A third side opposite the point may be sized to allow partial insertion of the locking strip into a second side groove while resisting complete insertion. The third side may have a radius configured to resist exit of the third side from the second side groove while the mesh is stretched.

In some embodiments, a tool for rotating a roller of a roller frame is described. The tool includes a gripper configured to engage a slot of the roller and apply a substantially tangential force to the roller for rotating the roller while a bearing surface applies a substantially radial force to a side of the roller. A body is coupled at a first end to the gripper and at a second end to the bearing surface. A handle is coupled to the body and configured to rotate the tool, thus, rotating the roller.

DETAILED DESCRIPTION

Mesh may be stretched between rollers of a roller frame using a torque tool to grip a locking strip slot disposed longitudinally in a roller. The torque tool may grip the locking strip slot at about the middle of the roller and turn the roller. A rectangular frame may support the roller frame in a planer configuration during stretching. Pins at the corners of the rectangular frame may hold the roller frame in position for stretching. A jack coupled to the rectangular frame about midway between the corners of the frame may be used to apply rotational force to the torque tool for rotating the roller. Four sides of the roller frame may be stretched and held under tension using four torque tools at the same time. A triangular locking strip may be stitched along an edge of the mesh for insertion into the locking strip slot from the top instead of the end of the locking strip slot.

Figure 1:
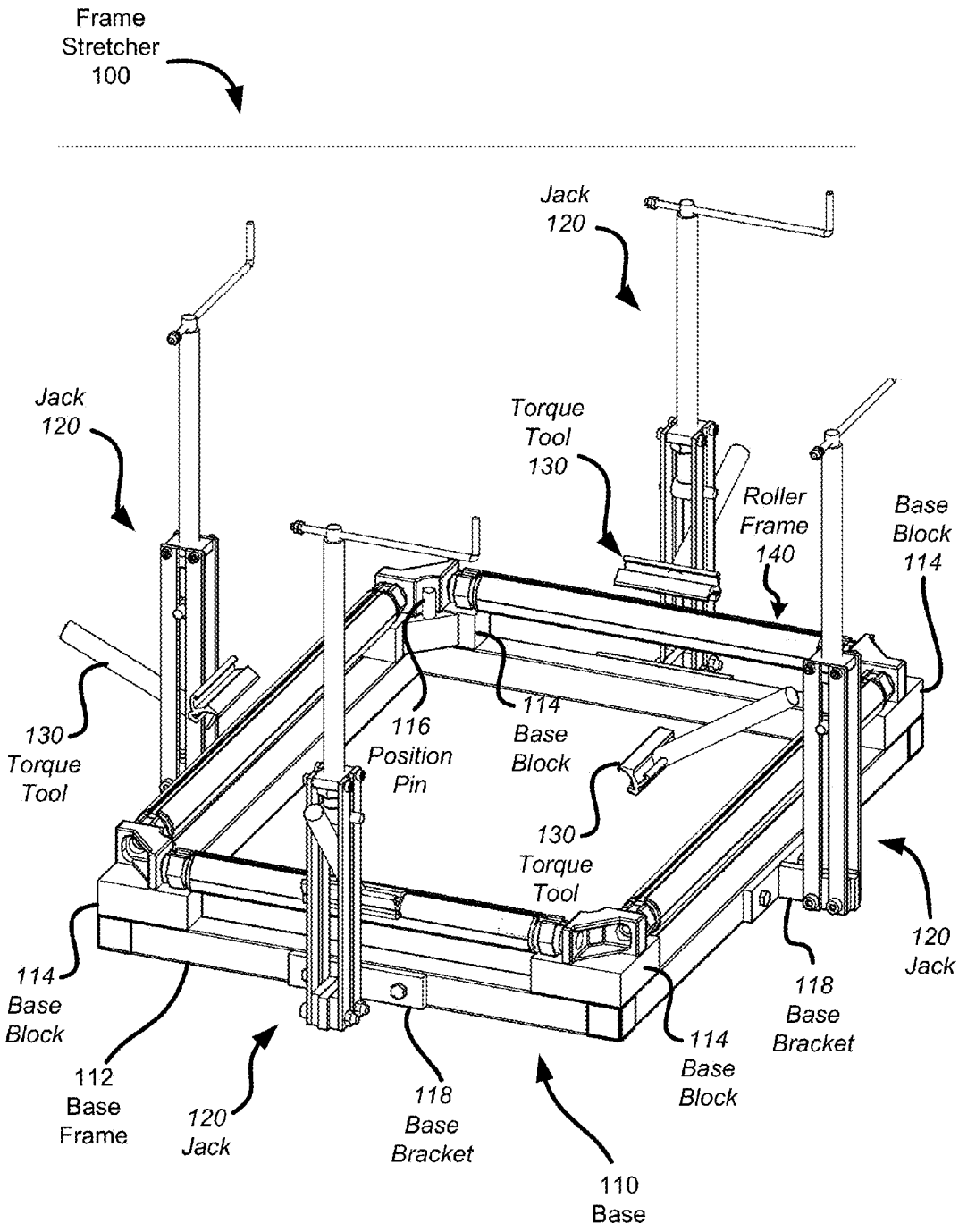
FIG. 1 is a front perspective view of an embodiment of a silkscreen roller frame stretcher, in accordance with aspects of the technology.

FIG. 1 is a front perspective view of an embodiment of a silkscreen roller frame stretcher 100, in accordance with aspects of the technology. The roller frame stretcher 100 of FIG. 1 illustrates an apparatus for applying torque to the center of one or more rollers of a roller frame 140 using a torque tool 130. The roller frame stretcher 100 is configured to apply torque to as many as four rollers simultaneously using four torque tools 130. The frame stretcher 100 includes a base 110 and a plurality of jacks 120 for applying the torque to the rollers via the torque tools 130.

The torque tools 130 are configured to grip the rollers of the roller frame 140 at about the middle of each of the rollers. The torque tools 130 also engage the jacks 120. The jacks 120 are configured to apply a downward force to the torque tools 130. The downward force on the torque tools 130 in turn applies torque to the rollers of the roller frame 140 for rotating the rollers about their respective centers. The torque applied to the rollers of the roller frame 140 rotates the top of each roller toward the outside of the frame stretcher 100, thus, stretching a mesh attached to each of the rollers.

The base 110 is configured for holding the roller frame 140 flat, or in about a plane during stretching. The base 110 includes a base frame 112, a plurality of base blocks 114, and a plurality of position pins 116. The base frame 112 of FIG. 1 is rectangular. The base frame 112 may be constructed using tubing joined at the corners. The tubing may form the sides of the base frame 112. The tubing may rectangular, round, triangular, pentagonal, hexagonal, heptagonal, octagonal, etc. The tubing material includes steel, aluminum, copper, brass, bronze, or other material having substantial strength and stiffness. Alternatively, tubing material for the base frame includes plastics, e.g., acrylic, carbonate, polypropylene, polyethylene, and etc. In some embodiments, the base frame 112 is fabricated using wood. The corners may be joined using welding, brazing, fasteners (e.g., screws, bolts, rivets, nails, brackets, and etc.), plugs, caps, adhesives, and/or the base blocks 114.

The base blocks 114 are configured to support the roller frame 140 during stretching of a mesh on the roller frame 140. The upper surfaces of the base blocks 114 may be coplanar. Thus, the roller frame 140 is held flat or planer during stretching. The base blocks 114 of FIG. 1 are disposed at each of the four corners of the base frame. The base blocks 114 may be attached to the corners of the base frame 112 using welding, brazing, fasteners (e.g., screws, bolts, rivets, nails, brackets, and etc.), brackets, plates, and/or adhesives. For clarity, the mesh is omitted in FIG. 1. The base blocks 114 are further configured to provide spacing between rollers of the roller frame and the tubing of the base frame 112. A position pin 116 may be disposed at each of the four corners of the base 110, e.g., on the base blocks 114. The position pins 116 are configured to engage the inner corners of the roller frame 140 and retain the roller frame 140 in position on the base blocks 114 during stretching.

The jacks 120 are coupled to the base 110 of FIG. 1 at about the middle of each side of the base frame 112. The jacks 120 may be attached to the base frame 112 using base brackets 118. The base brackets 118 may be attached using welding, brazing, fasteners (e.g., screws, bolts, rivets, nails, brackets, and etc.), plugs, caps, adhesives, and/or the like. The base brackets 118 of FIG. 1 are attached to the base frame using bolts. While the jacks 120 illustrated in FIG. 1 are inverted screw jacks, other devices may be used for applying force to a handle of the torque tool 130, for example, pneumatic jacks, scissors jacks, pneumatic pistons, crank and track, hydraulic jacks, cables and pulleys, winches, and/or the like.

Figure 2:
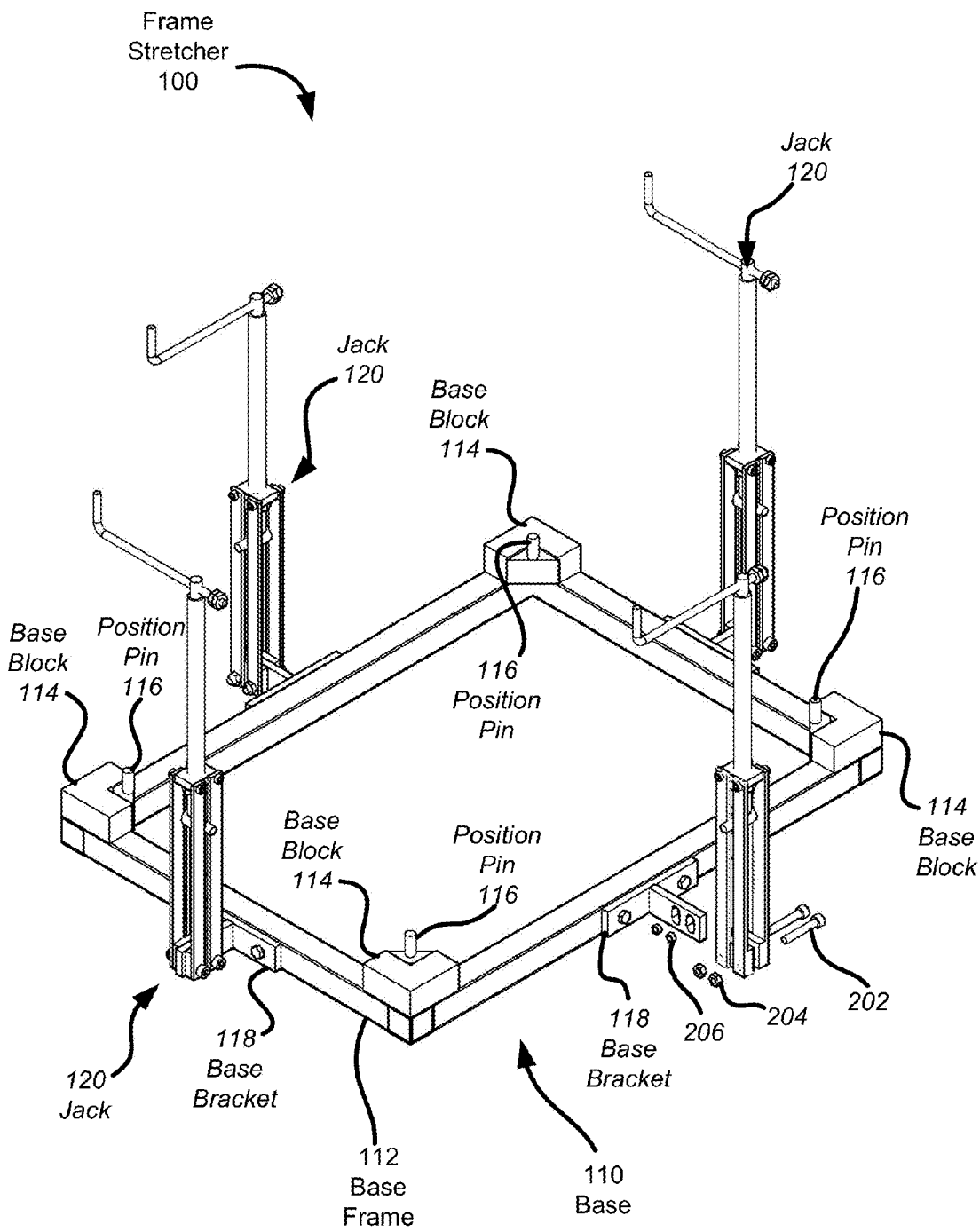
FIG. 2 is a front perspective view and partial exploded view of the frame stretcher of FIG. 1.

FIG. 2 is a front perspective view and partial exploded view of the frame stretcher 100 of FIG. 1. The roller frame 140 and torque tools 130 have been omitted for clarity. An attachment of one of the jacks 120 to the respective base bracket 118 is illustrated in exploded view. The jack 120 of FIG. 2 is secured to the base bracket 118 using bolts 202 and nuts 204. Spacers 206 may be disposed on the bolts 202. The spacers 206 may be sized for sliding in slots of the base bracket 118. Alternatively, screws, rivets, pins, etc. may be used for securing the jack 120 to the base bracket 118.

Figure 3:
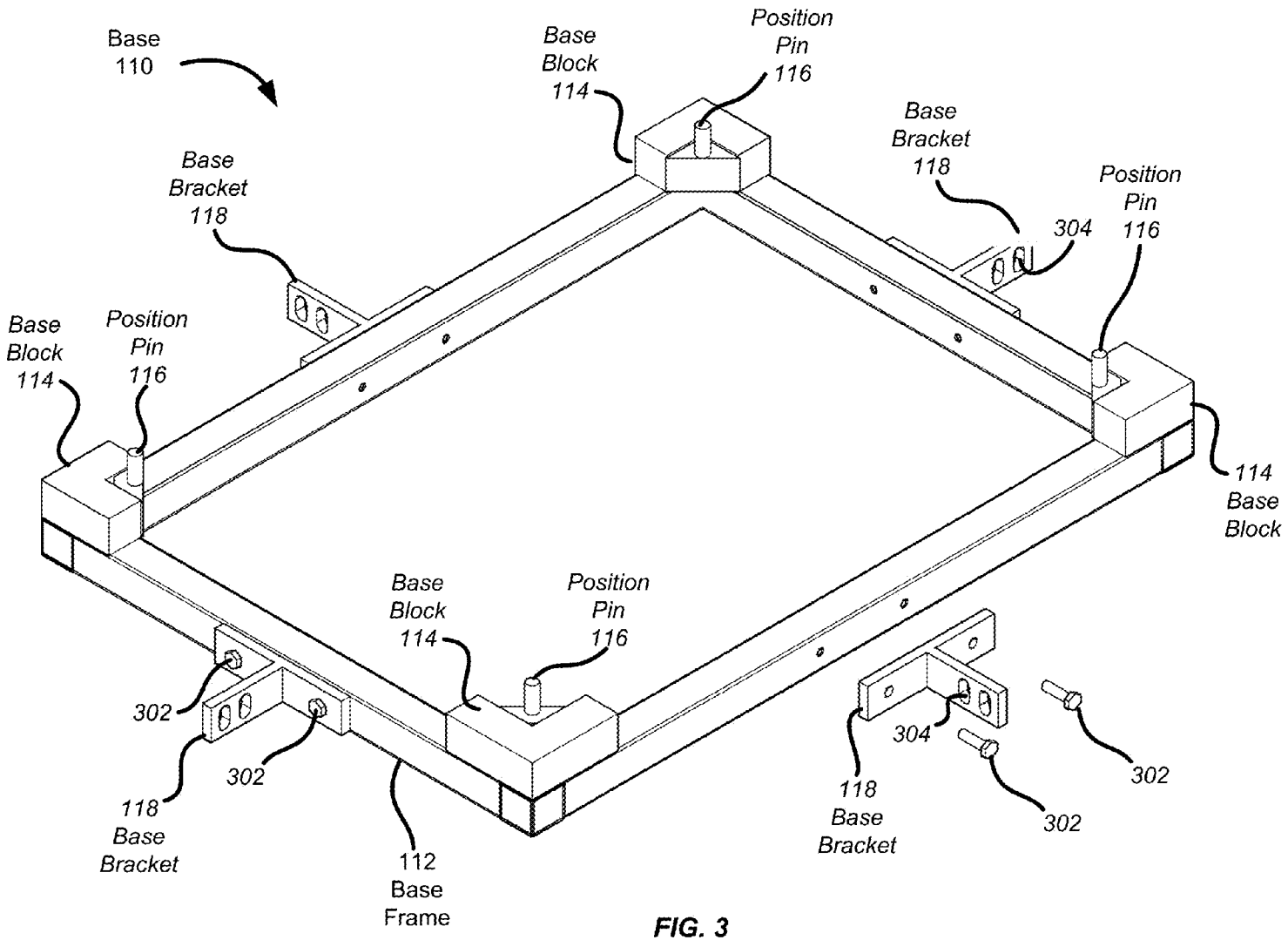
FIG. 3 is a front perspective view and partial exploded view of the base of FIG. 1.

FIG. 3 is a front perspective view and partial exploded view of the base 110 of FIG. 1. FIG. 3 illustrates details for attaching the base bracket 118 to a side of the base frame 112. The base bracket 118 of FIG. 3 is attached to the side of the base frame 112 using screws 302. The base bracket 118 includes two slots 304 for engaging the bolts 202 that secure the jack 120 to the base bracket 118. The slots 304 are configured to provide for rotation of the jack 120 in a plane about normal to the base frame 112 and includes the center of the base frame 112. The spacers 206 may provide a bearing surface for the bolts 202 within the slots 304.

Figure 4:
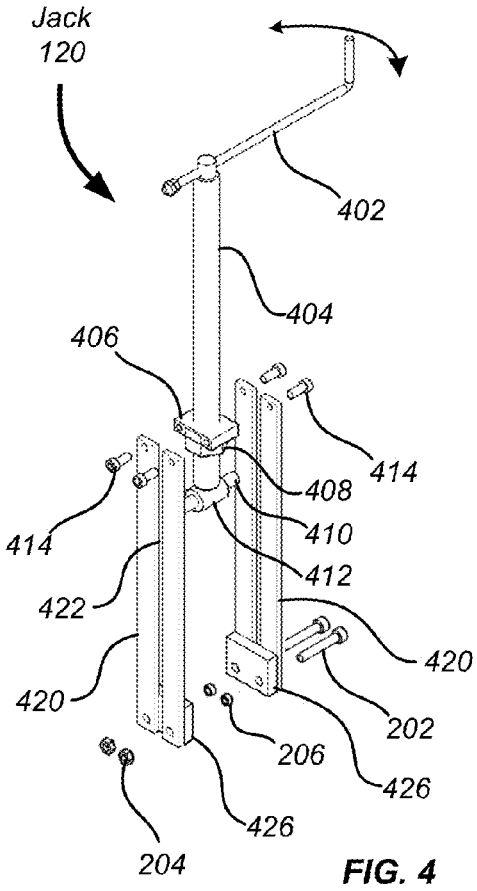
FIG. 4 is a front perspective exploded view illustrating details of a jack of FIG. 1.

FIG. 4 is a front perspective exploded view illustrating details of the screw jack 120 of FIG. 1. The jack 120 of FIG. 4 includes a handle 402, a threaded lead screw 404, a plate 406, a nut 408, a tool bearing 412, four sidebars 420 and two brackets 426. The nut 408 may be attached to the plate 406, e.g., using welding. The plate 406 may be affixed to an upper end of the sidebars 420 using screws 414. The tool bearing 412 may be rotationally secured to a lower end of the lead screw 404.

The handle 402 is configured to rotate the lead screw 404. The lead screw 404 is threaded into the nut 408. As the lead screw is rotated using the handle 402, the lead screw 404 advances or retracts with respect to the nut 408, depending on the direction of rotation. The nut 408 and plate 406 are fixed relative the sidebars 420. Thus, the tool bearing 412 on the lower end of the lead screw 404 advances or retracts relative the sidebars 420.

Each of the brackets 426 is rigidly affixed to a lower end of two of the sidebars 420, e.g., using welding. Each bracket 426 holds the two sidebars 420 parallel and maintains a uniform gap along the length of the sidebars 420 to form a slot 422 between the sidebars 420. The tool bearing 412 includes pins 410 configured to engage the slot 422. As the lead screw 404 extends, the pins 410 travel along the slot 422. Thus, the slot 422 constrains the lead screw to remain parallel to the sidebars 420. The tool bearing 412 is configured to bear on a handle of the torque tool 130, as illustrated elsewhere herein, and apply a downward force on the torque tool.

Figure 5:
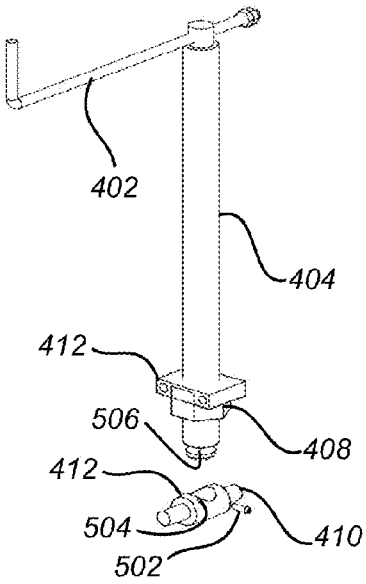
FIG. 5 is a front perspective exploded view illustrating details of the tool bearing attachment to a lead screw of FIG. 4.

FIG. 5 is a front perspective exploded view illustrating details of the tool bearing 412 attachment to the lead screw 404 of FIG. 4. The lower end of the lead screw 404 includes a groove 506. The tool bearing 412 includes a pin hole 504 that is configured to receive a pin 502. The pin 502 may engage the groove 506 for rotationally securing the tool bearing 412 to the lower end of the lead screw 404. Thus, the pins 410 of the tool bearing 412 may remain within the slot 422 during rotation of the lead screw 404.

Figure 6:
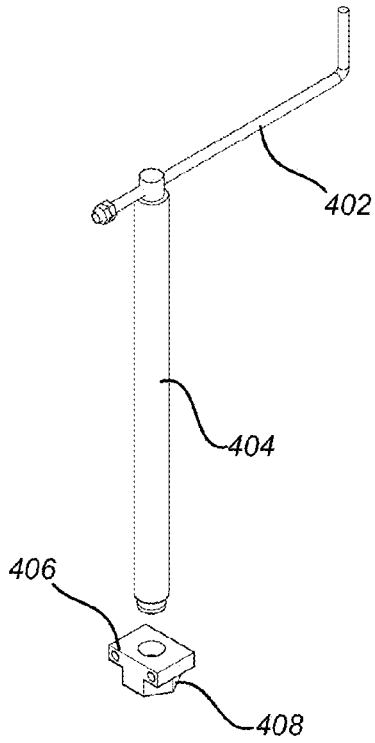
FIG. 6 is a front perspective exploded view illustrating details of an engagement of the lead screw in the plate and nut of FIG. 4.

FIG. 6 is a front perspective exploded view illustrating details of the engagement of the lead screw 404 in the plate 406 and nut 408. Threads of lead screw 404 may engage the nut 408. The plate 406 may include threads which also engage the lead screw 404. Alternatively, the plate 406 does not include threads. In some embodiments, the plate 406 and nut 408 may be fabricated as a single assembly using a single piece of material. For example, the fabricated assembly may be machined, cast, injection molded, sintered, etc.

Figure 7:
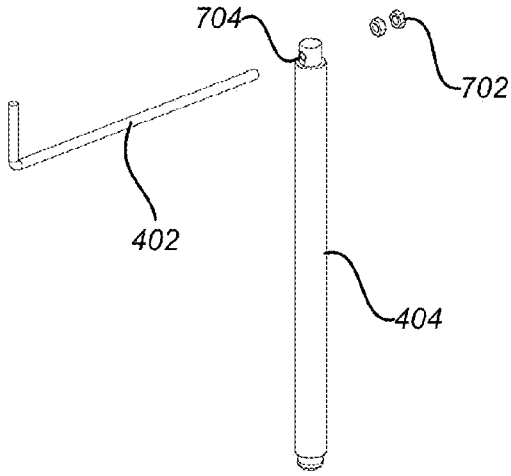
FIG. 7 is a front perspective exploded view illustrating details of attachment of a handle to the lead screw of FIG. 4.

FIG. 7 is a front perspective exploded view illustrating details of attachment of the handle 402 to the lead screw 404 of FIG. 4. The handle may be attached to the lead screw 404 using nuts 702 as illustrated in FIG. 4. The handle 402 of FIG. 7 is configured to slide within an aperture 704 in the lead screw 404. In some embodiments, the handle is pressed into the aperture 704. The handle may be further secured using an adhesive, welding, soldering, etc. Alternatively, handle 402 is threaded and screwed into a tapped aperture 704.

Figure 8A:
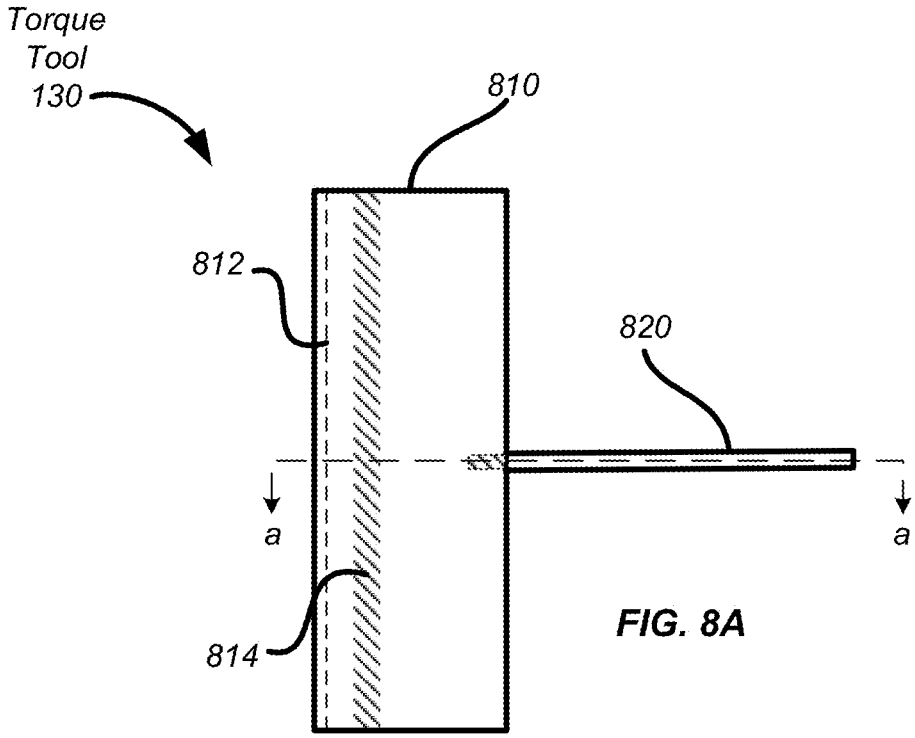
FIG. 8A is a top plan view illustrating details of a torque tool of FIG. 1.
Figure 8B:
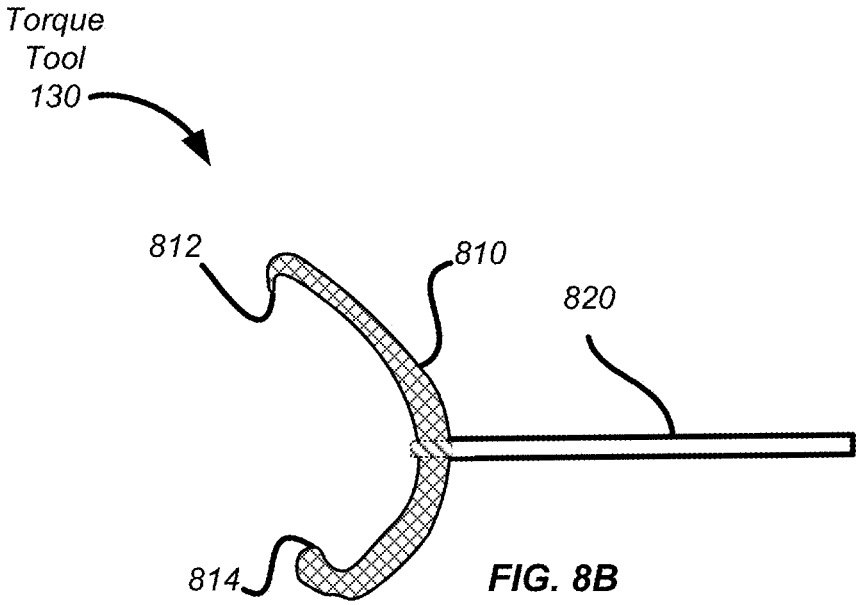
FIG. 8B is a cross section view of the torque tool taken along line a-a of FIG. 8A.

FIG. 8A is a top plan view illustrating details of the torque tool 130 of FIG. 1. FIG. 8B is a cross section view of the torque tool 130 taken along line a-a of FIG. 8A. The torque tool 130 includes a body 810 and a handle 820. The body 810 includes a roller grip 812 and a roller bearing 814. The roller grip 812 serves to apply torque and roller bearing 814 serves as a fulcrum for applying the torque using the torque tool 130. A separation of the roller grip 812 and the roller bearing 814 may be in a range of about 0.85 inches to 1.7 inches.

Figure 9A:
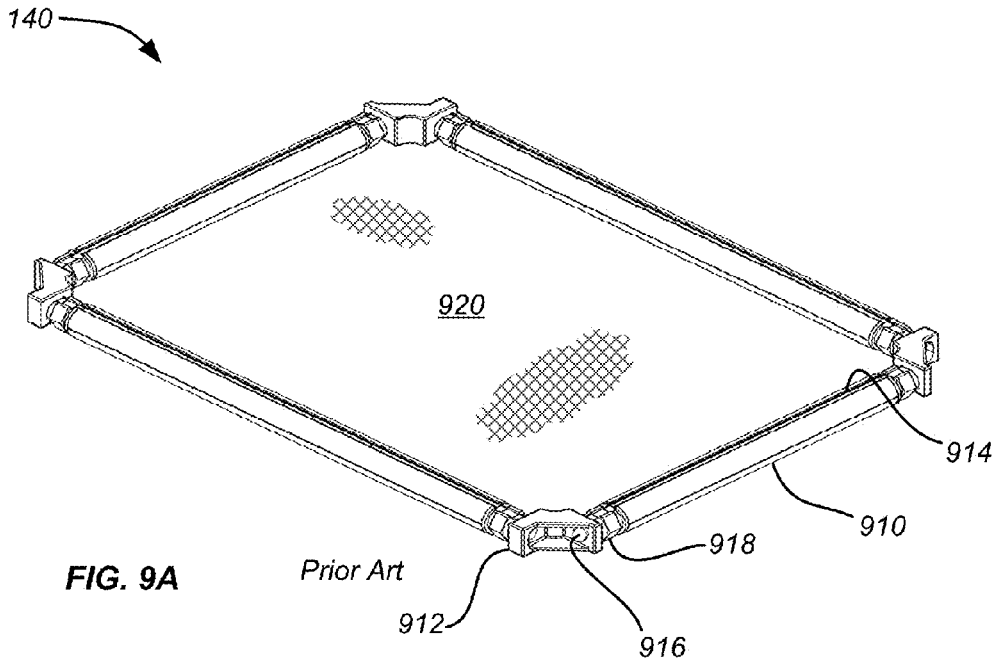
FIG. 9A Prior Art
FIG. 9A is a front perspective view a prior art roller frame.

FIG. 9A is a front perspective view a prior art roller frame 140. The roller frame 140 is configured for suspending a mesh panel 920 under tension. The roller frame 140 includes four rollers 910, four corner brackets 912, and eight end plugs 918. Each roller includes a locking strip slot 914 disposed along the length of the roller 910. Two end plugs 918 are inserted into each roller 910, one at each end of the roller 910. The four corner brackets 912 are disposed at the corners of the roller frame 140. The corner brackets 912 are configured for attaching to adjacent end plugs 918 to join the rollers 910, thus, forming a rectangle. Bolts 916 secure the corner brackets 912 to the end plugs. When tightened, the bolts hold the orientation of the end plugs 918 against rotation while the mesh panel 920 is under tension.

The locking strip slot 914 is configured for attaching the mesh panel 920 to the roller 910, as illustrated elsewhere herein. The rollers 910 may be rotated for applying tension to the mesh panel 920. Two bolts 916 disposed at opposite ends of a roller 910 may be tightened for preventing rotation of the roller 910 and maintaining tension on the mesh panel 920, once the mesh panel 920 is at a desired tension. The two bolts 916 may be partially loosened to allow additional tension to be applied to the mesh panel 920 and then retightened to hold the additional tension. Alternatively, the tension on the mesh panel 920 to be decreased while the two bolts 916 are partially loosened, and then retightened. The rollers 910 may be rotated one at a time for adjusting tension on the mesh panel 920. Alternatively, rollers 910 on opposite sides of the mesh panel 920 may be rotated at the same time. In some embodiments, all the bolts 916 may be loosened for rotation of rotation of all four rollers 910 to adjust tension on the mesh panel 920.

Figure 9B:
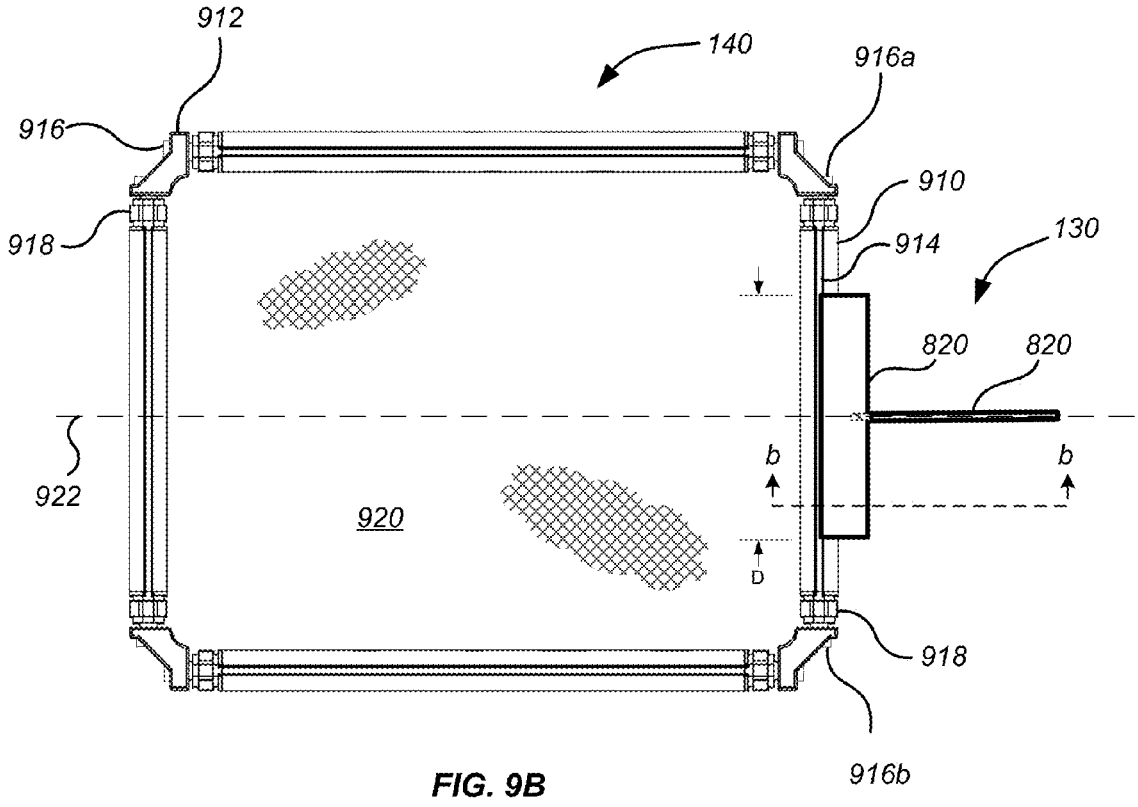
FIG. 9B is a top plan view of the roller frame and the torque tool of FIG. 1.

FIG. 9B is a top plan view of the roller frame 140 and the torque tool 130. The torque tool 130 illustrated in FIG. 9B is disposed at approximately a mid point along the roller 910, or at about the center. A centerline 922 of the roller frame 140 is indicated by a dashed line. The handle 820 may be positioned along the centerline 922.

Figure 10:
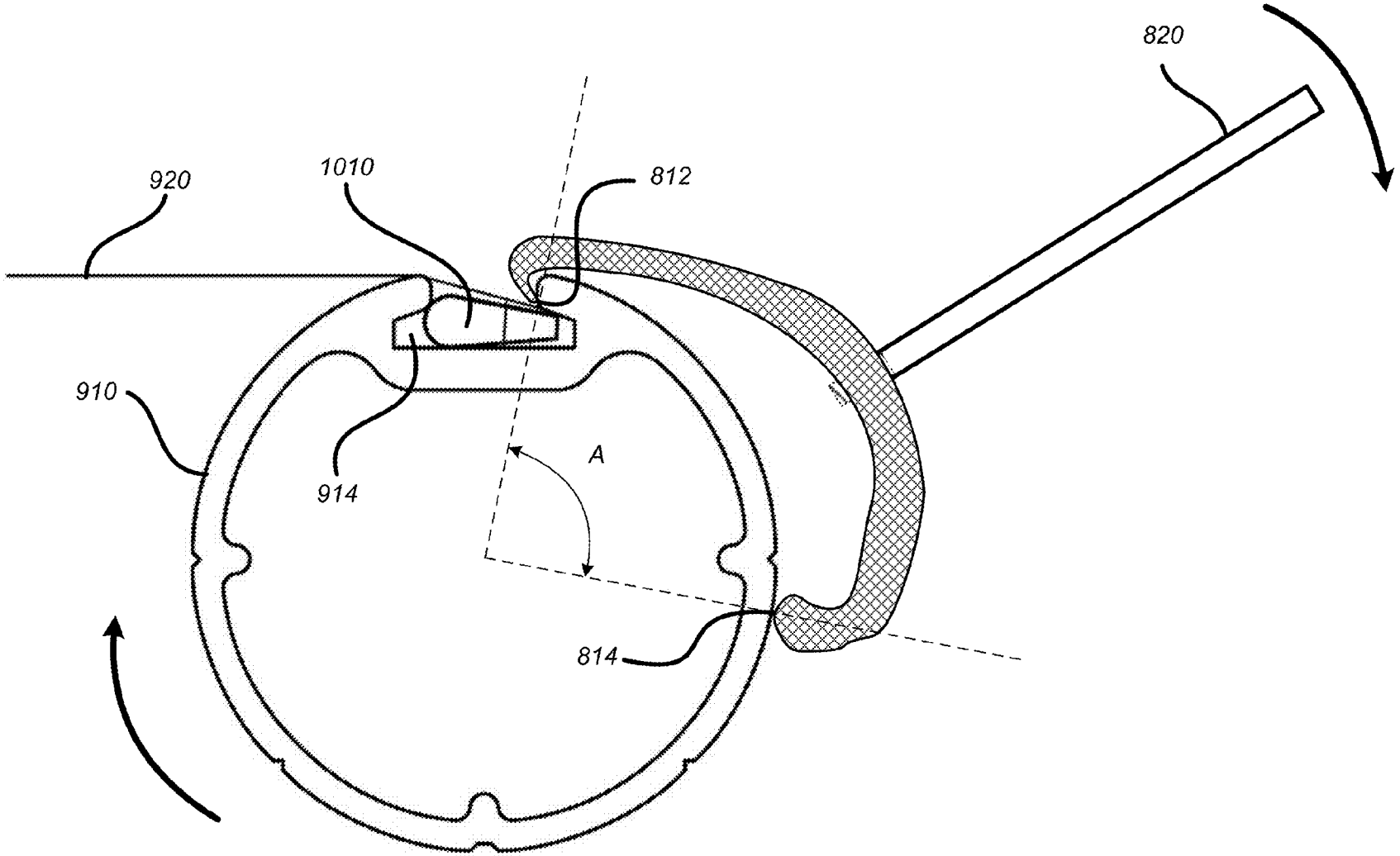
FIG. 10 is a cross section of the torque tool and the roller taken along line b-b of FIG. 9B.

FIG. 10 is a cross section of the torque tool 130 and the roller frame 140 taken along line b-b of FIG. 9B. The torque tool 130 of FIG. 10 is configured to engage the locking strip slot 914 using the roller grip 812. The bearing 814 secures the roller grip 812 against the locking strip slot 914. A force applied to the handle 820 exerts an approximately tangential force on the roller grip 812 and an approximately radial force on the bearing 814. This results in a torque on the roller 910 causing a rotation of the roller 910. For example, a downward force on the handle 820 causes a clockwise rotation of the roller 910. A locking strip 1010 secures the mesh panel 920 in the locking strip slot 914. A clockwise rotation of the roller 910 applies tension to the mesh panel 920. A separation of the roller grip 812 and the bearing 814 is configured to form an angle A. The angle A is illustrated in FIG. 10 as about 90 degrees, however angle A may be any angle in a range of about 20 to about 170 degrees.

Referring to FIG. 9B, pushing down (into the page) on the handle 820 rotates the top of the roller 910 away from the center of the mesh panel 920, thus, applying tension to the mesh panel 920. (This is the same rotation as results from pushing down on the handle 820 in FIG. 10.) Upon reaching a desired tension on the mesh panel 920, the bolts 916*a* and 916*b* may be tightened for holding the roller 910 at the desired orientation and maintaining tension on the mesh panel 920.

Referring still to FIG. 9B, a length "D" of the torque tool body 810 is configured to apply torque to the roller 910 along about a length D of the roller 910 for rotating the roller 910. Applying torque to the length D of the roller 910 provides longitudinal support to the roller 910 and reduces bowing of the roller 910 due to tension from the mesh panel 920 and radial force of the bearing 814. A minimum for length D is about 1 inch. The roller grip 812 also exerts a force on the locking strip slot 914. The force is distributed along a length D of the locking strip slot 914, thus, minimizing damage to the roller 910 and/or the locking strip slot 914. The torque tool 130 also applies the torque in line with the centerline 922 at about the center of the length of the roller 910. Thus, rotation of the roller 910 is uniform along its entire length. Moreover, the torque from the torque tool 130 is applied equally at each end of the roller 910 and tension on the mesh panel 920 is symmetrical about the centerline 922. Upon tightening the bolts 916*a* and 916*b* to prevent rotation of the roller 910, a reverse torque due to tension on the mesh panel 920 may be resisted by the roller 910 symmetrically about the centerline 922 and along the length of the roller 910. The symmetrical resistance serves to maintain the roller frame 140 flat and maintain the mesh panel 920 in a plane.

For clarity and simplicity, only one torque tool 130 is illustrated FIG. 9B. However it may be appreciated that all four rollers 910 of the roller frame 140 may be engaged using a torque tool 130 for each roller 910. It may be further appreciated that the roller frame stretcher 100 is configured for engaging all four rollers 910 and applying torque simultaneously using four torque tools 130, one for each roller 910, as indicated in FIG. 1. Thus, tension on the mesh panel 920 may be exerted simultaneously by four torque tools 130 while the jacks 120 are adjusted independently or in various combinations for balancing the tension and for fine adjustment of balance and amount of tension.

Figure 11:
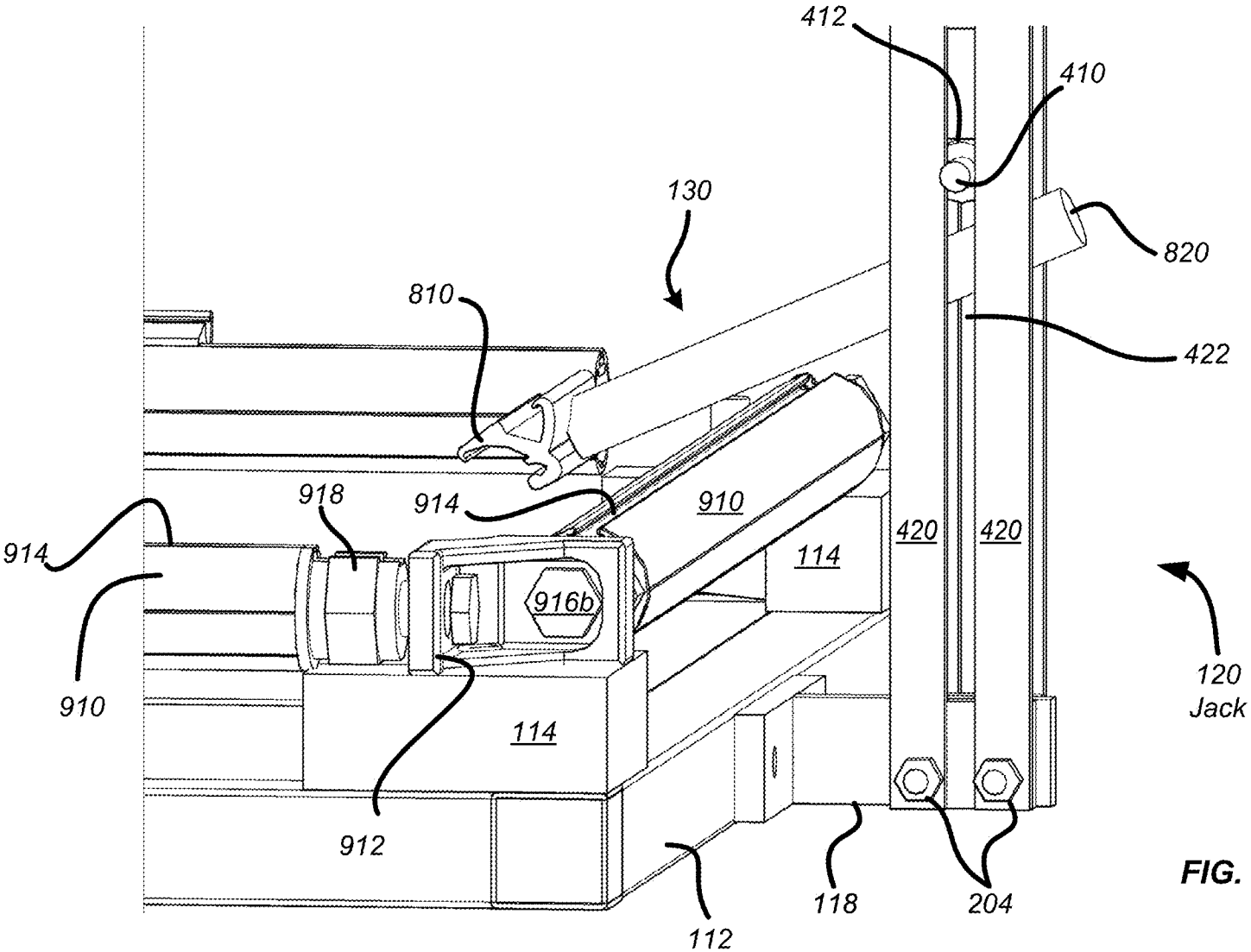
FIG. 11 is a perspective partial view of the frame stretcher illustrating details of a corner of FIG. 1.

FIG. 11 is a perspective partial view of the frame stretcher 100 illustrating details of a corner of FIG. 1. For clarity and simplicity, the mesh panel 920 is not shown. The bolt 916*b* and 916*a* (not visible in this perspective) may be loose to permit free rotation of the roller 910. The corner bracket 912 is supported on the base block 114. The handle 820 of the torque tool 130 may be positioned within the jack 120 before or after roller grip 812 of the body 810 engages the locking strip slot 914. The handle 820 may be inserted between a first and a second pair of sidebars 420 below the tool bearing 412.

Figure 12:
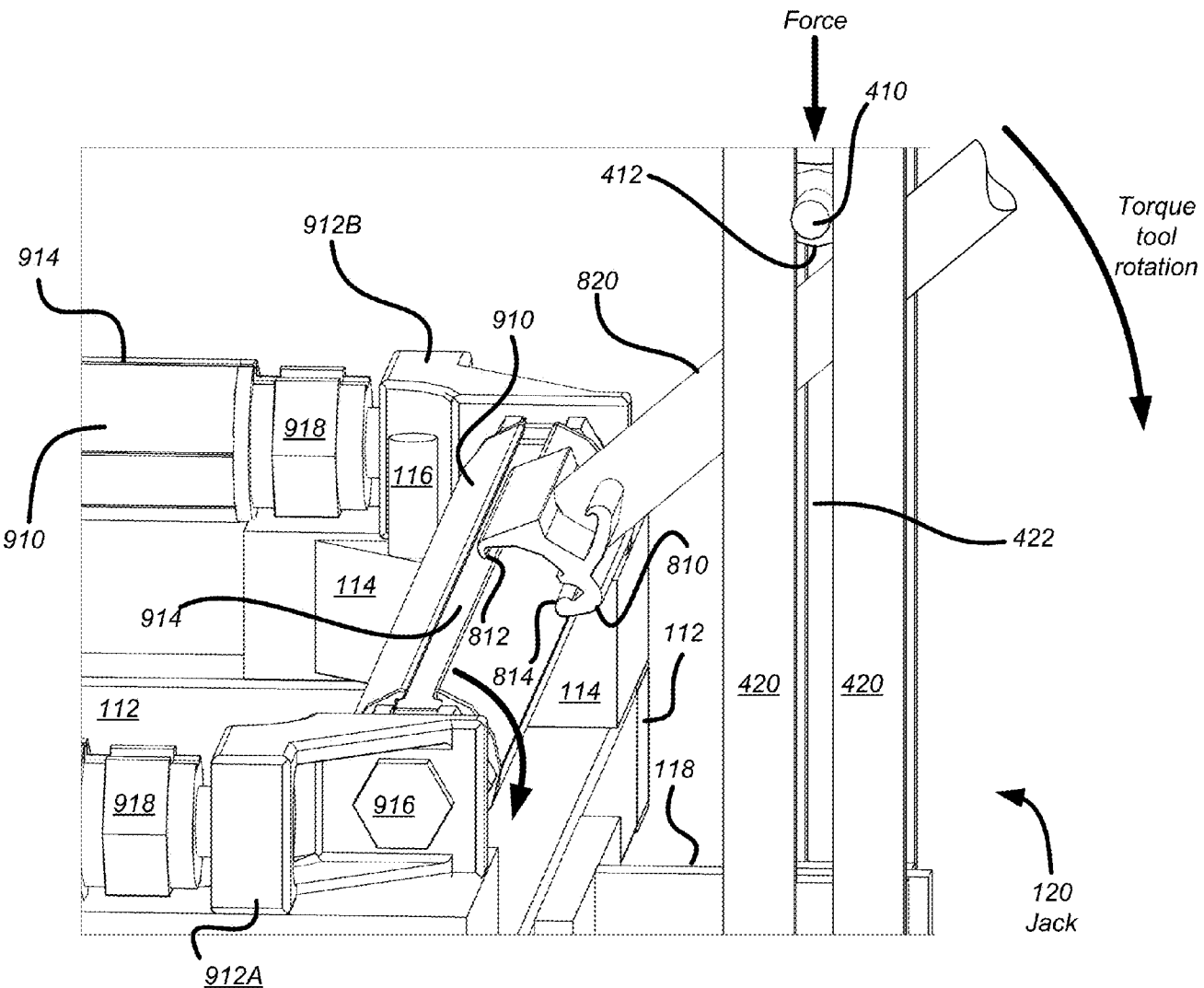
FIG. 12 is a perspective partial view of the frame stretcher illustrating details of a corner of FIG. 1.
Figure 13:
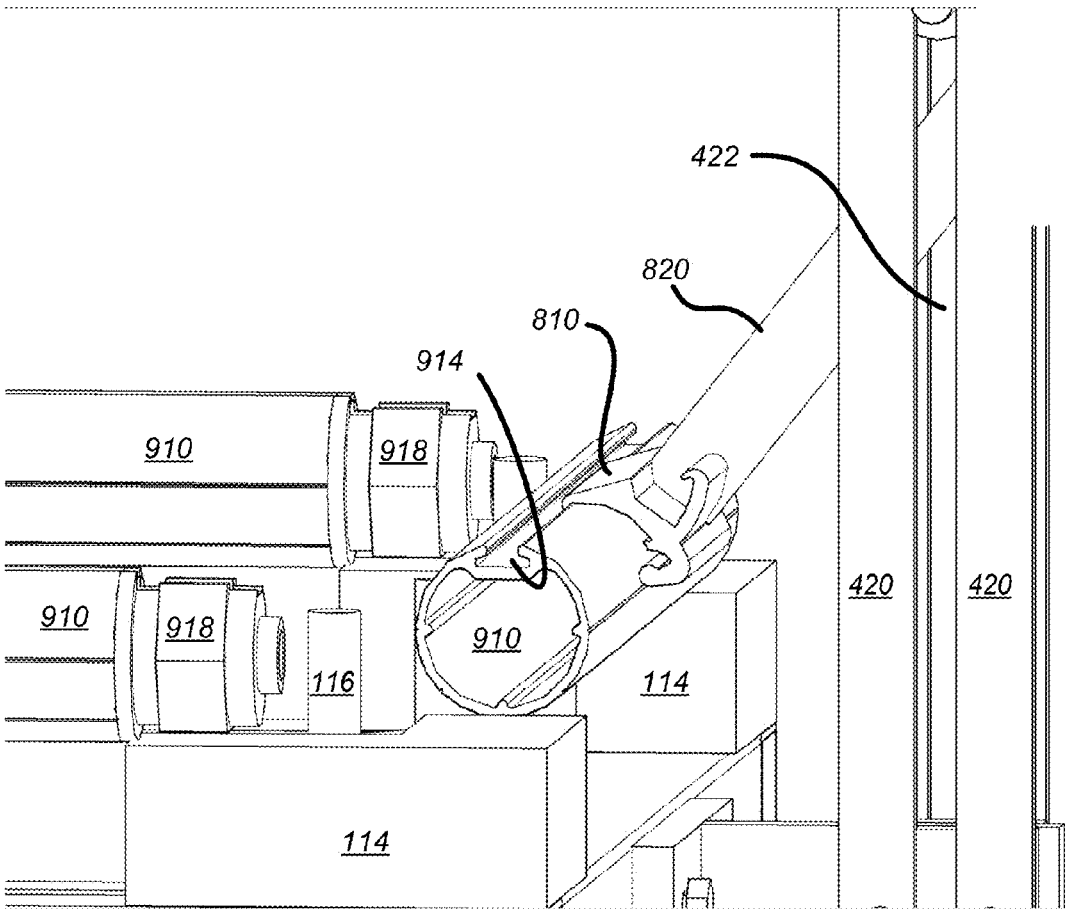
FIG. 13 is a partial cross section view of the roller of FIG. 12.

FIG. 12 is a perspective partial view of the frame stretcher 100 illustrating details of a corner of FIG. 1. FIG. 13 is a cutaway cross section view of the roller 910 of FIG. 12. For clarity and simplicity, the mesh panel 920 (illustrated elsewhere herein) is not shown in FIGS. 12 and 13. The roller grip 812 and the bearing 814 engage the roller 910. The handle 402 (illustrated elsewhere herein) of the jack 120 may rotate the lead screw 404 (illustrated elsewhere herein) resulting in downward travel of the tool bearing 412. The slots 422 may constrain the pins 410 such that the tool bearing 412 travels along the axis of the jack 120 and sidebars 420. The slot 422 may further prevent rotation of the tool bearing 412 with the rotation of the lead screw 404. The downward travel of the tool bearing 412 exerts a force on the handle 820 of the torque tool 130. The downward force on the handle 820 results in torque on the roller 910 via the torque tool 130 and a counter clockwise rotation of the roller 910. Rotation of the roller 910 applies tension to the mesh panel 920. Once a desired tension on the mesh panel 920 is obtained, a mechanical advantage of the lead screw 404 may hold the torque tool in position against the tension. The other three jacks 120 and torque tools 130 may be used in a similar manner to rotate each of the rollers 910 in turn. Thus, each of the four rollers 910 may be rotated to a position that exerts a desired tension on the mesh panel 920. The process may be iterative in that the desired tension on each of the rollers 910 may be adjusted (increased or decreased) several times in turn. The lead screw 404 provides a substantial mechanical advantage, which enables very fine adjustment of the tension on the mesh panel 920. Simultaneous use of opposing jacks 120 permits applying equal and opposite force on the mesh panel 920, thus, balancing tension and avoiding sliding the mesh panel 920 towards either end. This reduces wrinkling of the mesh panel 920 while under tension.

Once the desired tension is reached the pair of bolts 916 that secure any one or all of the rollers 910 may be tightened. Re-tensioning is also simplified. The pair of bolts 916 holding a roller 910 may be loosened while the jack 120 and torque tool 130 prevents counter rotation of the roller 910. Further adjustment of the tension on the mesh panel 920 may be performed while monitoring tension on the mesh panel 920. Then the bolts 916 may be tightened again to hold the roller 910 in its adjusted orientation.

The base blocks 114 provide separation between the roller 910 and the base frame 112, allowing the body 810 of the torque tool 130 to rotate to a position between the roller 910 and the base frame 112. This provides additional range of rotation of the torque tool 130. The top surfaces of the base blocks 114 may be coplanar. Thus, the corner brackets 912 may be coplanar when supported on the base blocks 114. A downward force applied to about the center of the roller 910 using the torque tool 130 may result in about equal force being exerted by the corner brackets 912A and 912B on the respective base blocks 114. Such equalization of forces facilitates a flat roller frame 140 and planar mesh panel 920 resulting from the above stretching process. Additional base blocks 114 (not illustrated) may be positioned on the base frame 112 at intermediate locations between the corners of the base 110 for providing additional support to rollers 910. Additional pins 116 may be attached to the additional base blocks 114 for reducing bowing of rollers 910.

Figure 14:
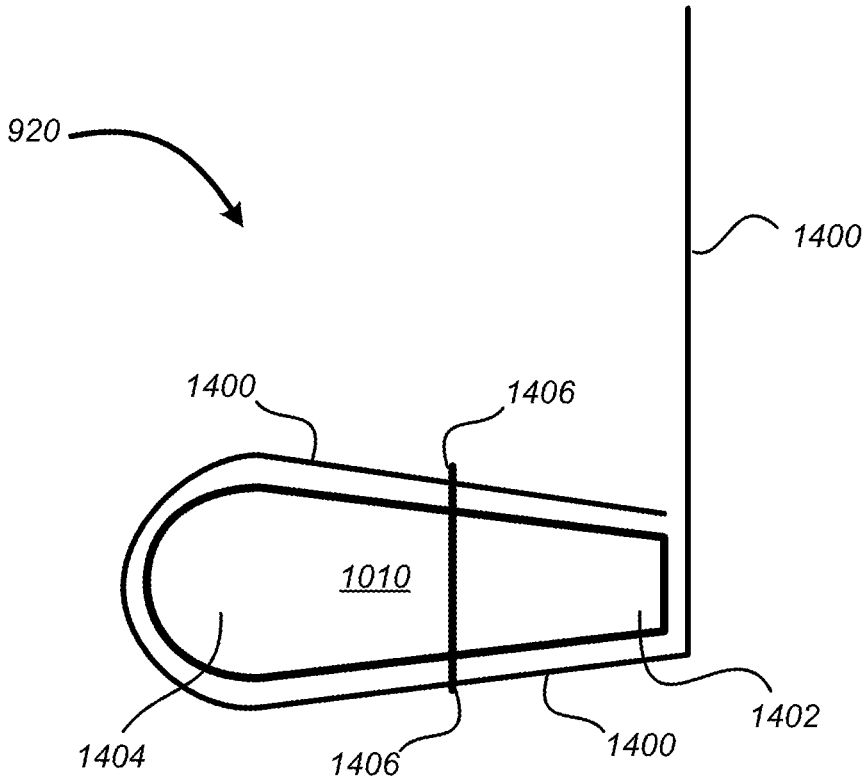
FIG. 14 illustrates a cross section view of an embodiment of the mesh panel of FIG. 1.

FIG. 14 illustrates a cross section view of an embodiment of the mesh panel 920 of FIG. 1. The mesh panel 920 includes a mesh 1400 folded around the locking strip 1010. The mesh 1400 may be sewn to the locking strip 1010 using stitching 1406 along the length of the locking strip 1010. The locking strip locking strip 1010 of FIG. 14 is about triangular, including a narrow end or narrow edge 1402 that approaches a point having a radius and a wide end or wide edge 1404 that includes a curve or radius. The narrow edge 1402 is configured for insertion into side grooves of the locking strip slot 914. The wide edge 1404 has a thickness that may be greater than a height of the locking strip side groves. Thus, the wide edge 1404 cannot be inserted into the side grooves of the locking strip slot 914, as illustrated in FIG. 10. In some embodiments, the wide end 1404 is sized for partial insertion into the side groves and includes a radius on the wide end 1404 that resists exit of the wide end 1404 from the side groves while the mesh panel 920 is under tension. The radius may extend over the entire wide end 1404 or form a process over a portion of the wide end as illustrated elsewhere herein (See, e.g., FIGS. 17-20). (For additional details see, e.g., U.S. Pat. No. 7,752,963, U.S. patent application Ser. No. 12/821,154, and U.S. patent application Ser. No. 12/832,979)

Figure 15A:
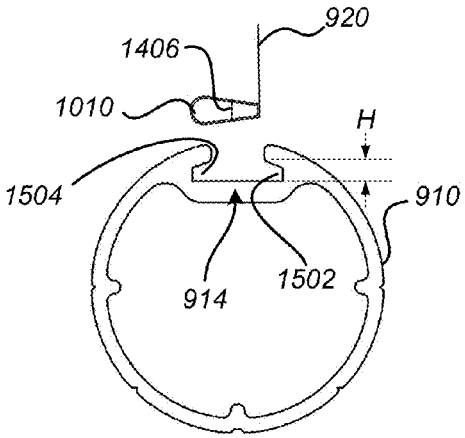
FIGS. 15A-D illustrates insertion of the locking strip into the locking strip slot of FIG. 10.
Figure 15B:
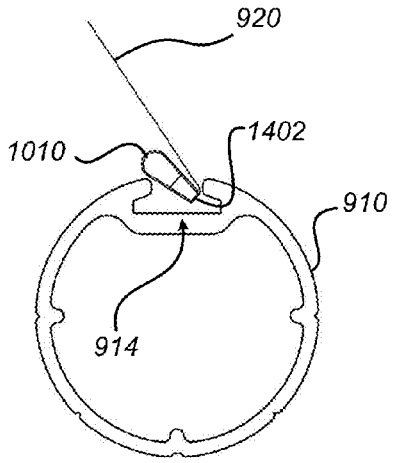
Figure 15C:
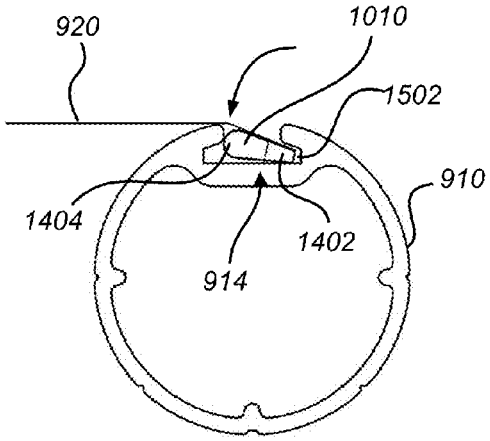
Figure 15D:
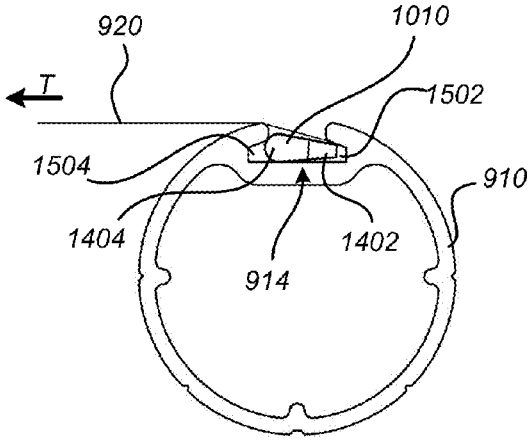

FIGS. 15A-D illustrates insertion of the triangular locking strip 1010 into the locking strip slot 914 of FIG. 10. The locking strip slot 914 may be described as having a shape of an inverted T. The locking strip slot 914 includes a first side groove 1502 and a second side groove 1504. The first side groove 1502 and the second side groove 1504 are disposed about symmetrically on either side of a center of the locking strip slot 914. Since the side grooves are symmetrical, the designation of first side groove and second side groove is arbitrary and refers to relative position with respect to a center of the roller frame. The side grooves 1502 and 1504 has a height "H." In FIG. 15A, the mesh panel 920, including the locking strip 1010, is positioned above the locking strip slot 914. In FIG. 15B, the narrow edge 1402 of the locking strip is sized for insertion into the locking strip slot 914. The width W of the locking strip 1010 is sized for rotation of the locking strip 1010 into the locking strip slot 914. In FIG. 15C, the narrow edge 1402 of the locking strip 1010 is inserted into the first side groove 1502 while the wide edge 1404 of the locking strip 1010 is rotated into the locking strip slot 914. In FIG. 15D, a tension "T" on the mesh 1400 forces the wide edge 1404 of the locking strip 1010 against the second side groove 1504. A thickness of the wide edge 1404 is greater than the height H of the second side groove 1504. Thus, the wide edge 1404 resists insertion of the locking strip 1010 into the second side groove 1504. The stitching 1406 secures the mesh 1400 to the locking strip 1010 and facilitates handling of the mesh panel 920 during insertion of the locking strip 1010 into the locking strip slot 914. A radius of the wide end 1404 of the locking strip 1010 serves to resist exit of the wide end 1404 from the second side groove 1504 while the mesh panel 920 is under tension.

Figure 16A:
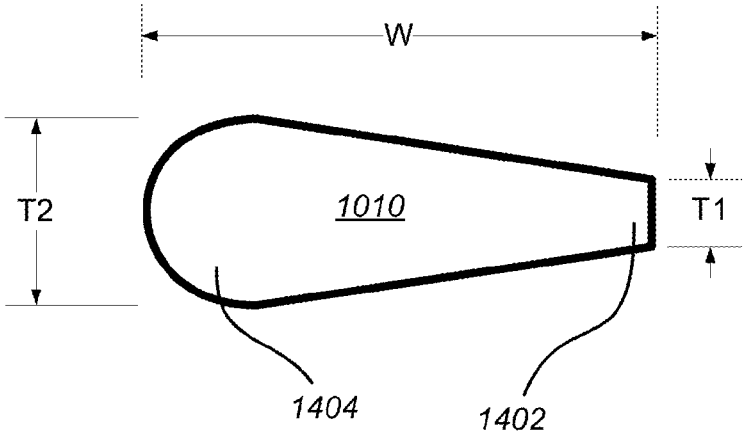
FIGS. 16A and 16B illustrate details of embodiments of the triangular locking strip of FIG. 14.
Figure 16B:
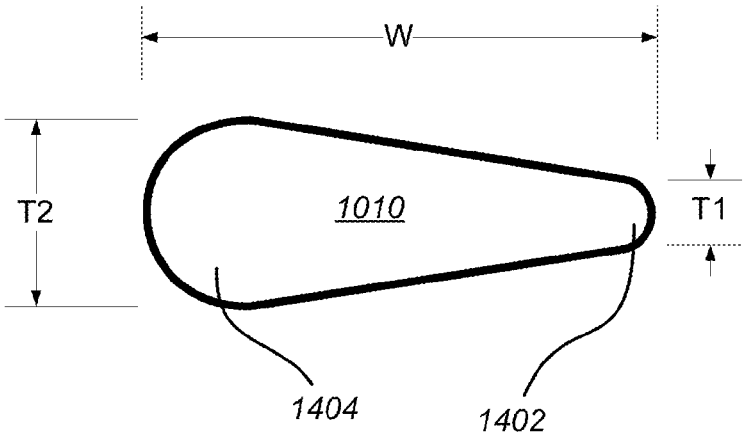
Figure 17:
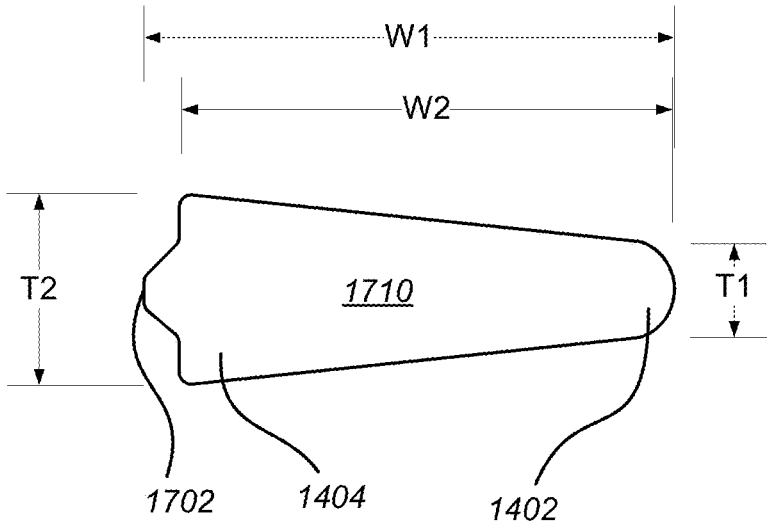
FIG. 17 illustrates details of an alternative embodiment of the locking strip of FIG. 14.
Figure 18:
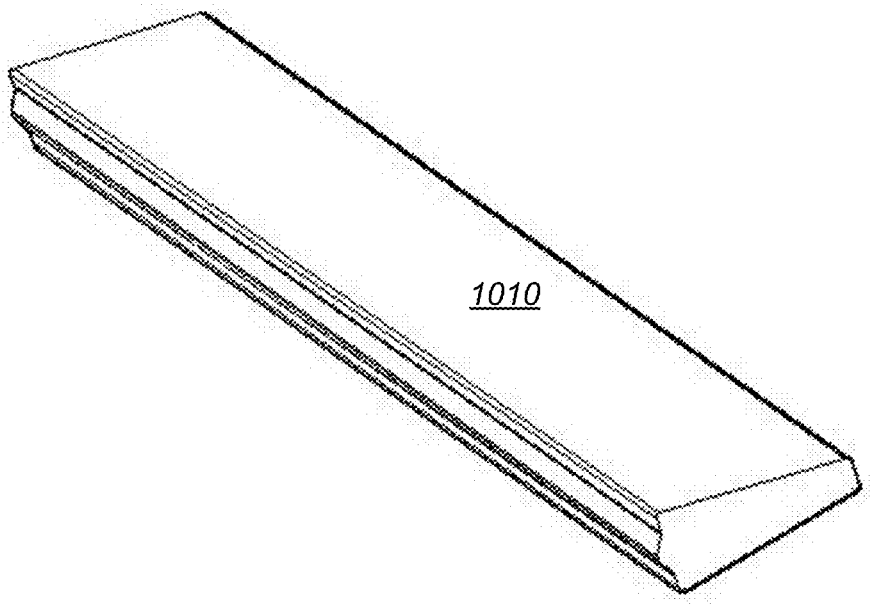
FIG. 18 illustrates a perspective view of a length of the locking strip of FIG. 17.

FIGS. 16A and 16B illustrate details of embodiments of the triangular locking strip 1010 of FIG. 14. The cross section of the locking strip 1010 has a width W, a narrow edge 1402 that approaches a point having a thickness T1 and a wide edge 1404 that has a thickness of T2. FIG. 16A differs from FIG. 16B in that the both the wide edge 1404 and the narrow edge 1402 of FIG. 16B have a radius whereas only the wide edge 1404 in FIG. 16A includes a radius. The thickness T2 is greater than the thickness T1. A typical thickness T1 is about 1.5 mm or less. The thickness T2 for the wide edge may be about 4 mm. The width W may be about 9.5 mm. A maximum for the thickness T1 is about 2.6 mm. A minimum for the width W is about 7 mm and a maximum for the width W is about 10 mm. A minimum for the thickness T2 is about 2.5 mm FIG. 17 illustrates details of an alternative embodiment of a triangular locking strip 1710. FIG. 18 illustrates a perspective view a length of the locking strip 1710 of FIG. 17. The locking strip 1710 of FIG. 17 differs from the locking strip 1010 of FIG. 14 in that the wide edge 1404 of the locking strip 1710 of FIG. 17 includes a process 1702 instead of a full radius. The process 1702 may be a radius over a portion of the wide edge 1404 instead of a radius over the entire wide edge 1404 as illustrated elsewhere herein (e.g., FIGS. 16A and 16B). The mesh 1400 and stitching 1406 are omitted in FIG. 17 for clarity. The process 1702 is configured to grip an upper edge of the second side groove 1504 to reduce a tendency to rotate out of the locking strip slot 914. That is, the shape of the process resists removal from exit of the locking strip 1710 from the second side groove 1504. The cross section of the locking strip 1710 has an overall width W1, a minor width W2, a narrow edge 1402 having a thickness T1 and a wide edge 1404 that has a thickness of T2. The thickness T2 is greater than the thickness T1. The thickness T1 may be about 1.5 mm. The thickness T2 for the wide edge may be about 4 mm. The overall width W1 may be about 9.5 mm. The small width W2 may be about 9.0 mm. A maximum for the thickness T1 is about 2.6 mm. A minimum for the width W1 is about 7 mm and a maximum for the width W1 is about 10 mm. A minimum for the thickness T2 is about 2.5 mm. The locking strips 1010 and/or 1710 may be fabricated using an extrusion and cut to a desired length.

Figure 19:
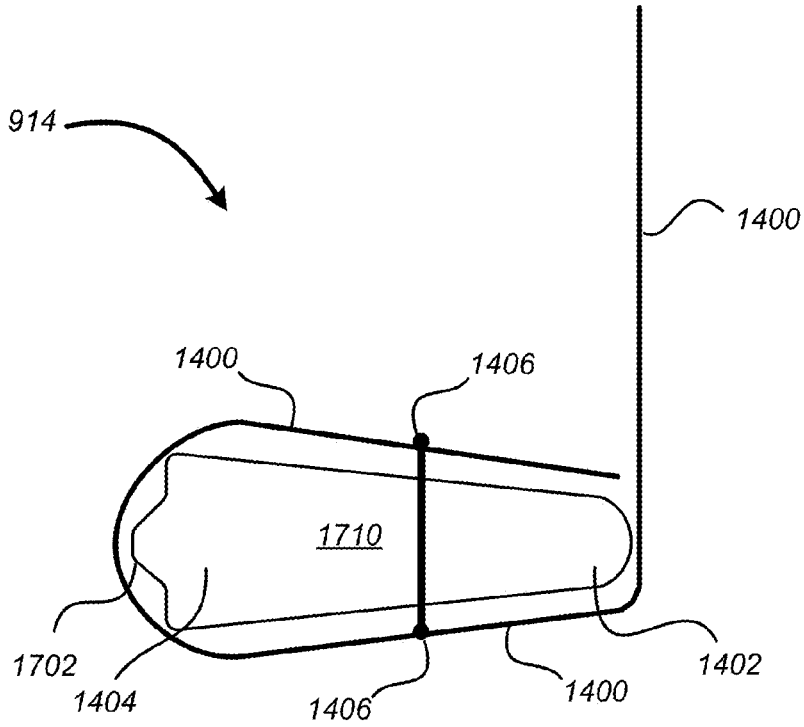
FIG. 19 illustrates a cross section of a mesh panel including the triangular locking strip of FIG. 17 and mesh.

FIG. 19 illustrates a cross section of a mesh panel 920 including the triangular locking strip 1710 of FIG. 17 and mesh 1400. The mesh 1400 is shown in cross section wrapped or folded around the locking strip 1710, and secured to the locking strip 1710 using the stitching 1406.

Figure 20:
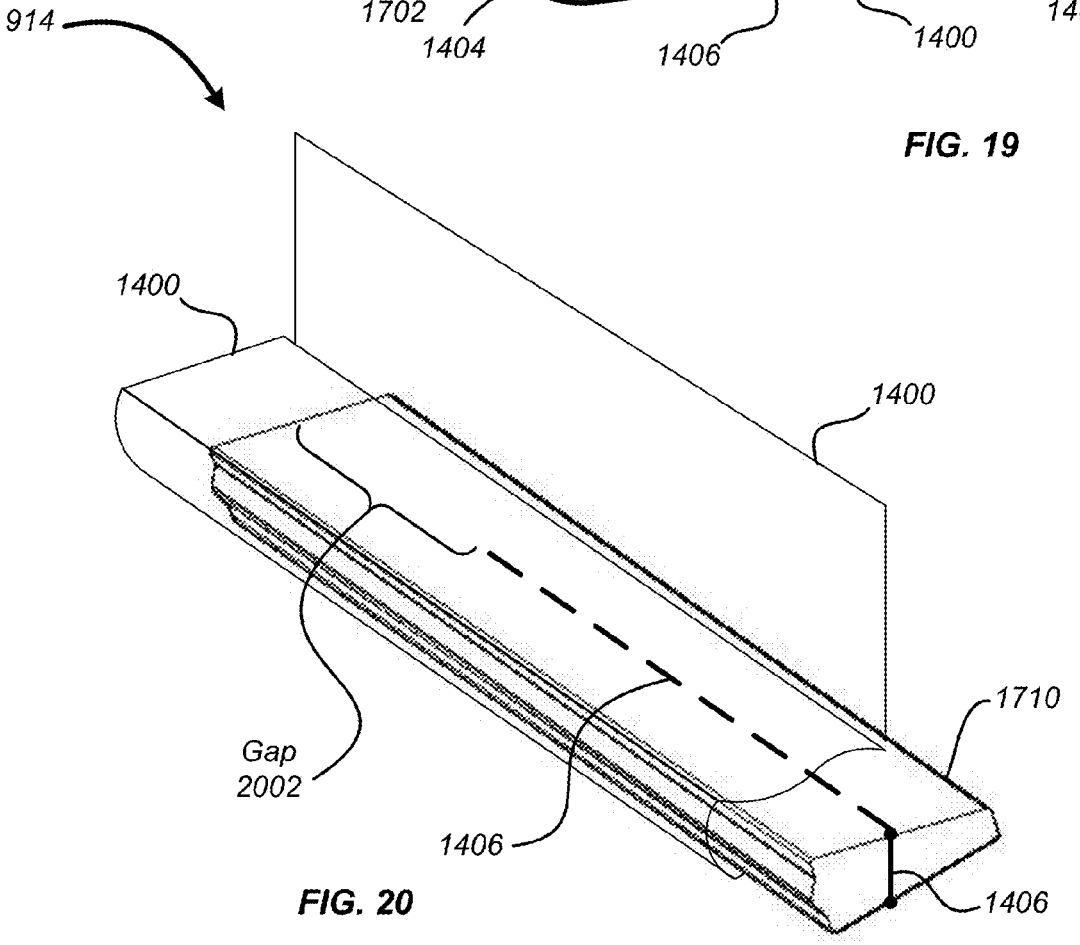
FIG. 20 illustrates the cutaway perspective view of an end portion of the mesh panel of FIG. 19.

FIG. 20 illustrates the cutaway perspective view of an end portion of an edge the mesh panel 920 of FIG. 19. The cutaway view shows a portion of the locking strip 1710 and mesh 1400. The mesh 1400 wrapped around the locking strip 1710 and the stitching 1406 securing the mesh 1400 to the locking strip 1710 are shown in perspective. The mesh 1400 is shown in cutaway to reveal a segment of the locking strip 1710 extending from within the mesh 1400. The mesh 1400 is also shown as transparent for illustration purposes. A gap 2002 between the end of the stitching 1406 and an end of the locking strip 1710 provides for corner softening. (For additional details see, e.g., U.S. patent application Ser. No. 12/821,154 and U.S. patent application Ser. No. 12/409,522.)

The embodiments discussed herein are illustrative. As these embodiments are described with reference to illustrations, various modifications or adaptations of the methods and/or specific structures described may become apparent to persons having ordinary skill in the art. All such modifications, adaptations, or variations that rely upon the teachings of the embodiments, and through which these teachings have advanced the art, are considered to be within the spirit and scope of the present application. Hence, these descriptions and drawings should not be considered in a limiting sense, as it is understood that the present application is in no way limited to only the embodiments illustrated.

What is claimed is:

1. A system for stretching a roller frame including a roller and a mesh panel, the system comprising:

a rectangular frame configured to support four corners of the roller frame at four respective corners of the rectangular frame, each side of the rectangular frame including:

a frame member configured to support a roller of the roller frame at opposite ends of the roller;

a torque tool including a body and a handle, the body positioned to grip the roller at an intermediate position about halfway between opposite ends of the roller for rotating the roller, the body of the torque tool further configured to apply torque to the roller at about the center of the roller upon application of a downward force on the handle to rotate the roller for applying tension to the mesh panel; and a jack attached to the frame member of the rectangular frame at an intermediate position about halfway between two corners of the rectangular frame, a tool bearing surface of the jack configured to be movable in an upward and downward direction and to apply a downward force to the handle of the torque tool to hold the torque tool and roller in position against the tension applied to the mesh panel.

2. The stretching system of claim 1, wherein the rectangular frame further comprises four blocks each disposed at a corner of the rectangular frame, top surfaces of the four blocks being about coplanar for supporting the roller frame at corners of the roller frame in a substantially planar configuration.

3. The stretching system of claim 2, further comprising four pins disposed at four corners of the rectangular frame and configured to hold the roller frame in a stretching position on the rectangular frame on the four blocks.

4. The stretching system of claim 1, wherein the torque tool comprises a grip configured to apply a tangential force to the roller and a bearing surface configured to apply a radial force to the roller.

5. The stretching system of claim 4, wherein a separation between the gripper and the bearing surface is configured to engage the roller at about 90 degrees of separation.

6. The stretching system of claim 4, wherein the jack is an inverted screw jack.

7. The stretching system of claim 1, wherein the mesh panel includes a locking strip stitched to an edge for securing mesh in a locking strip slot of the roller, the locking strip cross section comprising:

a generally triangular shape;

a first edge having a first thickness configured to allow insertion of the first edge into a first side groove of the locking strip slot;

a second edge having a second thickness larger than the first thickness, the second thickness configured to resist insertion of the second edge into a second side groove of the locking strip slot.

8. The stretching system of claim 1 wherein the torque tool comprises:

a gripper configured to engage a slot of the roller and apply a substantially tangential force to the roller;

a bearing surface configured to apply a substantially radial force to a side of the roller;

a body coupled at a first end to the gripper and at a second end to the bearing surface, and the handle coupled to the body and configured to rotate the torque tool and the roller.

9. The stretching system of claim 8, wherein the gripper engages at least one quarter of a length of the roller slot.

10. The stretching system of claim 8, wherein a separation between the gripper and the bearing surface is configured to engage the roller at a separation around the roller of between about 10 degrees and 170 degrees.

11. The stretching system of claim 8, wherein the gripper of the torque tool is positioned to engage a portion of the slot of the roller including a midpoint between ends of the roller.

12. The stretching system of claim 1, wherein the tool bearing surface of the jack includes a pin that is positioned to apply a force to the handle, the force configured to apply a torque to the roller for holding the roller in position.

13. The stretching system of claim 1, wherein the jack includes a lead screw for moving the tool bearing surface up and down.

* * * * *